US005709490A

United States Patent [19]

Dyas

[11] Patent Number: 5,709,490

[45] Date of Patent: Jan. 20, 1998

[54] FOOT BRUSH

[75] Inventor: Robert J. Dyas, Queensland, Australia

[73] Assignee: Innovative Products NZ Limited, New Zealand

[21] Appl. No.: 633,753

[22] PCT Filed: Oct. 11, 1994

[86] PCT No.: PCT/NZ94/00104

§ 371 Date: May 20, 1996

§ 102(e) Date: May 20, 1996

[87] PCT Pub. No.: WO95/10970

PCT Pub. Date: Apr. 27, 1995

[30] Foreign Application Priority Data

Oct. 21, 1993 [NZ] New Zealand ..... 250022

[51] Int. Cl.[6] ..... A46B 11/00

[52] U.S. Cl. ..... 401/19; 15/104.92; 15/106; 15/160; 15/161; 401/268

[58] Field of Search ..... 401/19, 22, 39, 401/268; 15/106, 160, 161, 104.92

[56] References Cited

U.S. PATENT DOCUMENTS

| | | | |
|---|---|---|---|
| 1,549,708 | 8/1925 | Burnett | 221/94 |
| 1,989,022 | 1/1935 | Perriehon | 401/19 |
| 2,131,500 | 9/1938 | Curtis, Jr. | 401/19 |
| 2,288,850 | 7/1942 | Share | 401/19 |
| 2,669,738 | 2/1954 | Kusznir | 15/122 |
| 2,760,218 | 8/1956 | Gottfried | 401/19 |
| 2,920,333 | 1/1960 | Montague et al. | 401/22 |
| 3,055,040 | 9/1962 | Schermerhorn | 15/525 |
| 3,270,366 | 9/1966 | Maichen | 15/559 |
| 4,050,825 | 9/1977 | Stein | 401/19 |

FOREIGN PATENT DOCUMENTS

| | | | |
|---|---|---|---|
| 161931 | 4/1931 | Australia . | |
| 7648291 | 11/1992 | Australia . | |
| 748709 | 4/1933 | France | 401/19 |
| 52-0470 | 4/1977 | Japan . | |
| 238979 | 12/1945 | Switzerland | 401/19 |

*Primary Examiner*—Steven A. Bratlie
*Attorney, Agent, or Firm*—Brown, Martin, Haller & McClain, L.L.P.

[57] ABSTRACT

A foot brush for cleaning or scrubbing a user's feet has a body with a front portion and a rear portion. A soap locating region is disposed in the front portion, and at least one tuft of bristles is embedded within and projects from the front portion in the vicinity of the soap locating region. The tuft of bristles may partially surround the soap locating region in a substantially U-shaped formation. The soap locating region may be in the form of a cavity formed within the front portion which is adapted to receive and retain a bar of soap. A rear portion of the body is designed for anchoring by one of the user's feet while the other foot is scrubbed.

19 Claims, 3 Drawing Sheets

FOOT BRUSH

TECHNICAL FIELD

This invention relates to a foot brush. More specifically, this invention relates to a foot brush for cleaning and/or scrubbing a user's feet, and in particular for cleaning and/or scrubbing human feet.

In this specification, the term "tuft of bristles" is understood to refer to or include both a single tuft of bristles or, more particularly, a plurality of tufts of bristles.

BACKGROUND ART

There are available several types of brushes which may be used for cleaning or scrubbing a user's feet.

A first type of brush currently available is a soft-bristled, hand-held brush, which a user may utilize to clean or scrub his/her body as well as his/her feet. This type of brush is sold under the trade mark BODY BRUSH. However, a disadvantage associated with using this brush is that the user has to bend down, usually while balancing on one foot, to clean or scrub his/her feet. This may present difficulties to people who have trouble bending or balancing, and in particular to elderly or obese people.

A second type of brush presently available which may be utilized for cleaning or scrubbing a user's feet is a brush which is releasably attachable to the floor of a shower or bath—by the use of suckers or other such means. The bristles of the brush protrude upwardly therefrom, and a user may therefore clean or scrub his/her feet by rubbing his/her feet over and along the bristles of the brush. One disadvantage associated with the use of this brush is that if the user wishes to soap either the brush or his/her feet, this involves bending down, usually while balancing on one foot. As for the BODY BRUSH brush described above, this may present difficulties to people who have trouble bending or balancing, and in particular to elderly or obese people. A further disadvantage associated with this second type of foot brush is that the releasable attachment means, such as suckers, may sometimes render the brush difficult to move or pull from the floor surface. The brush may not therefore be particularly movable or mobile, and this may present problems, especially for weak, frail or elderly people.

It is an object of the present invention to provide a foot brush for use in cleaning and/or scrubbing a user's feet.

It is a further object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a foot brush comprising:

a) a body having a front portion and a rear portion, b) a soap locating region disposed upon or within the front portion, c) a tuft of bristles, embedded within and projecting from the front portion, in the vicinity of the soap locating region.

Preferably, the tuft of bristles partially surrounds the soap locating region, and may be in a substantially U-shaped formation around the soap locating region. The open end of the U-shaped formation of the tuft of bristles preferably faces the rear portion of the body.

Preferably, the foot brush has a cavity formed in the front portion of the body. The cavity is adapted to receive and retain a bar of soap.

According to another aspect of the present invention there is provided the combination of a foot brush, substantially as described above, and a bar of soap specifically shaped or of an appropriate dimension to fit within or upon the soap locating region.

According to another aspect of the present invention there is provided a method of cleaning or scrubbing human feet, utilising the foot brush substantially as described above, comprising the steps of:

a) placing a foot on the rear portion of the body of the foot brush to prevent or restrict the foot brush from moving, b) cleaning or scrubbing the other foot by rubbing it backwards and/or forwards over or through the tuft of bristles and/or the bar of soap of the foot brush.

In one embodiment, the foot brush may comprise or consist of a body, the body having a front portion and a rear portion. There may also be a soap locating region disposed upon or within the front portion of the body, and a tuft of bristles, embedded within and projecting from the front portion, in the vicinity of the soap locating region.

Any arrangement of the tuft of bristles on the front portion of the body and/or in the vicinity of the soap locating region may be utilized as required or as desired.

In one embodiment, the tuft of bristles may partially surround the soap locating region, to therefore partially enclose a bar of soap to be placed within or on the soap locating region. In such an embodiment, the tuft of bristles may preferably be in a substantially U-shaped formation around or about the soap locating region. The open end of the U-shaped formation of bristles preferably faces the rear portion of the body to allow immediate or simultaneous access to the soap held in the soap locating region when a user of the foot brash passes his/her foot forwards and through the tuft of bristles.

In another embodiment of the invention, the tuft of bristles may fully surround the soap locating region. An advantage associated with such an embodiment is that the soap is less likely to be dislodged when the foot brush is being used, given that the soap is completely enclosed within or surrounded by the tuft of bristles.

The tuft of bristles may preferably be embedded within and project from the front portion of the body of the foot brush. Any angle of the bristles with respect to the front portion of the body, or the body itself, may be utilized. However, in a preferred embodiment, some or all of the tuft of bristles may be inclined or angled towards the rear portion of the body of the foot brush. In such an embodiment, the tips or ends of the tuft of bristles are therefore angled towards a user's foot as it is being pushed forward through the tuft of bristles. This has the effect of digging into and cleaning a user's feet more efficiently as compared to an embodiment which has the tuft of bristles projecting substantially vertically from the front portion of the body and/or angled away from the rear portion of the body of the brush.

Any suitable bristles may be utilized as required or as desired or as dictated by the type of cleaning or scrubbing action required of the foot brush. Preferably the tuft of bristles may consist of crimped nylon bristles.

The rear portion of the body may be of any suitable size, shape or configuration as required or as desired, or as dictated by the size or shape of a user's foot or feet. In a preferred embodiment, the rear portion of the body may comprise or consist of a substantially flat flange-type portion.

The rear portion of the body may be adapted or designed to be engaged by one foot of a user of the foot brush, to thus retain the foot brush and/or to prevent the foot brush from moving while the user cleans or scrubs the other foot with the foot brush. The rear portion may be adequately engaged or retained simply by applying downward pressure to the rear portion, namely by standing and placing weight upon the rear portion with one foot.

The rear portion may be provided with any suitable means for assisting the engagement of the rear portion by a user's foot. For example, the rear portion may be provided with indentations designed to substantially match the shape of a user's foot, and such indentations may also include areas for the toes of the user to locate and/or grip. The rear portion may also or alternatively be provided with a non-slip surface to aid the retention thereof by a user's foot.

The rear portion of the body may be provided with means for allowing the foot brush to be hung from a wall. For example, the rear portion may be provided with an aperture.

The front portion of the body may be of any suitable size, shape or configuration as required or as desired or as dictated by the size or shape by user's foot or feet.

The front portion of the body may preferably be raised or elevated relative to the rear portion of the body. One advantage of such an embodiment is that the front portion, being raised relative to the rear portion, allows for the tuft of bristles and/or soap retained or disposed thereon to be readily accessed by a user's foot. For example, such an embodiment ensures that the foot placed upon the rear portion of the body does not interfere with the other foot as it is being cleaned or scrubbed by being passed backwards and/or forwards over or through the tuft of bristles and/or soap of the foot brush.

The first and rear portions of the body of the foot brush may be releasably attachable to each other by any suitable releasable attachment means.

In a preferred embodiment the first and rear portions of the body of the foot brush may be integrally formed. In such an embodiment, the first and rear portions may preferably be formed from injection moulding techniques, and may preferably be formed of polypropylene. However, any other suitable material(s) may be utilised as required or as desired.

The soap locating region may take any shape or form, although it should be of a suitable form to be able to receive a bar of soap thereon or therein, and be able to sufficiently retain the bar of soap when a user of the foot brush is scrubbing his/her feet.

In one embodiment, the soap locating region may be defined by the tuft of bristles embedded within and projecting from the front portion of the body. That is, the bar of soap may be retained within the soap locating region by the tuft of bristles partially surrounding or fully surrounding the region. In such an embodiment, it may be preferable to have the tuft of bristles fully surrounding the soap locating region, and therefore the bar of soap.

In another embodiment, the soap locating region may be in the form of, a cavity formed within the front portion of the body, the cavity being adapted to receive a bar of soap. The bar of soap should preferably be of approximately the same size, configuration or dimensions as the cavity. Preferably, the bar of soap should be a substantially snug fit within the cavity. In such an embodiment the tuft of bristles partially or fully surrounding the cavity may further assist in retaining the bar of soap within the cavity.

Preferably, the cavity may be integrally formed within the first portion.

The soap locating region, being a cavity or otherwise, may preferably be provided with drainage holes to allow for water and/or soap to drain therefrom. This would help to prevent the bar of soap from becoming soggy or otherwise deteriorating which would occur if water were to be trapped within the soap locating region during times when the foot brush was not being used.

There may also be provided additional means for assisting in the retention of the bar of soap within or upon the soap locating region. For example, a soft, small, and preferably flexible, plastic screw could be screwed through the underside of the front portion of the body of the foot brush and into the underside of the bar of soap. Such a screw would have to be a soft, flexible plastic screw so that it would not hurt a user's foot when the soap has worn down to a point where the screw will come into contact with a user's foot as it passes over the bar of soap.

Preferably, the underside of the body of the foot brush may consist of or comprise a substantially flat surface. This is so that the foot brush will lie substantially flush or flat with a floor surface.

The foot brush, substantially as described above, may be utilised in the following manner. A user of the foot brush may place a foot on the rear portion of the body of the foot brush to prevent the foot brush from moving. The user may then clean or scrub the other foot by rubbing it backwards and/or forwards over or through the tuft of bristles of the foot brush. Given that the bar of soap is located by or retained within the soap locating region, it may be appreciated that the foot brush is essentially a self-soaping foot brush. Hence, one advantage of the invention is that a user of the foot brush does not have to separately soap the brash or his/her feet.

Once a foot has been sufficiently cleaned or scrubbed, the user of the foot brush may swap feet placing the freshly cleaned or scrubbed foot on the rear portion of the body of the foot brush, and the other foot is similarly cleaned or scrubbed by rubbing it backwards and/or forwards over or through the tuft of bristles of the foot brush.

In another embodiment of the present invention, the foot brush may comprise or consist of a body, a soap locating region disposed upon or within the body, and a tuft of bristles embedded within and projecting from the body, in the vicinity of the soap locating region. This embodiment essentially comprises a self-soaping foot brush without a rear portion for preventing movement of the foot brush when it is being used.

The bar of soap may preferably be in the form of a solid bar of soap, although it is to be appreciated that the term "bar of soap" as used in this specification is deemed to also include other forms of soap such as liquid soaps and the like.

The bar of soap to be utilised with the foot brush may preferably be provided with anti-fungal products to prevent common foot diseases such as athlete's foot, and the like.

BEST MODES FOR CARRYING OUT THE INVENTION

Figure 1:
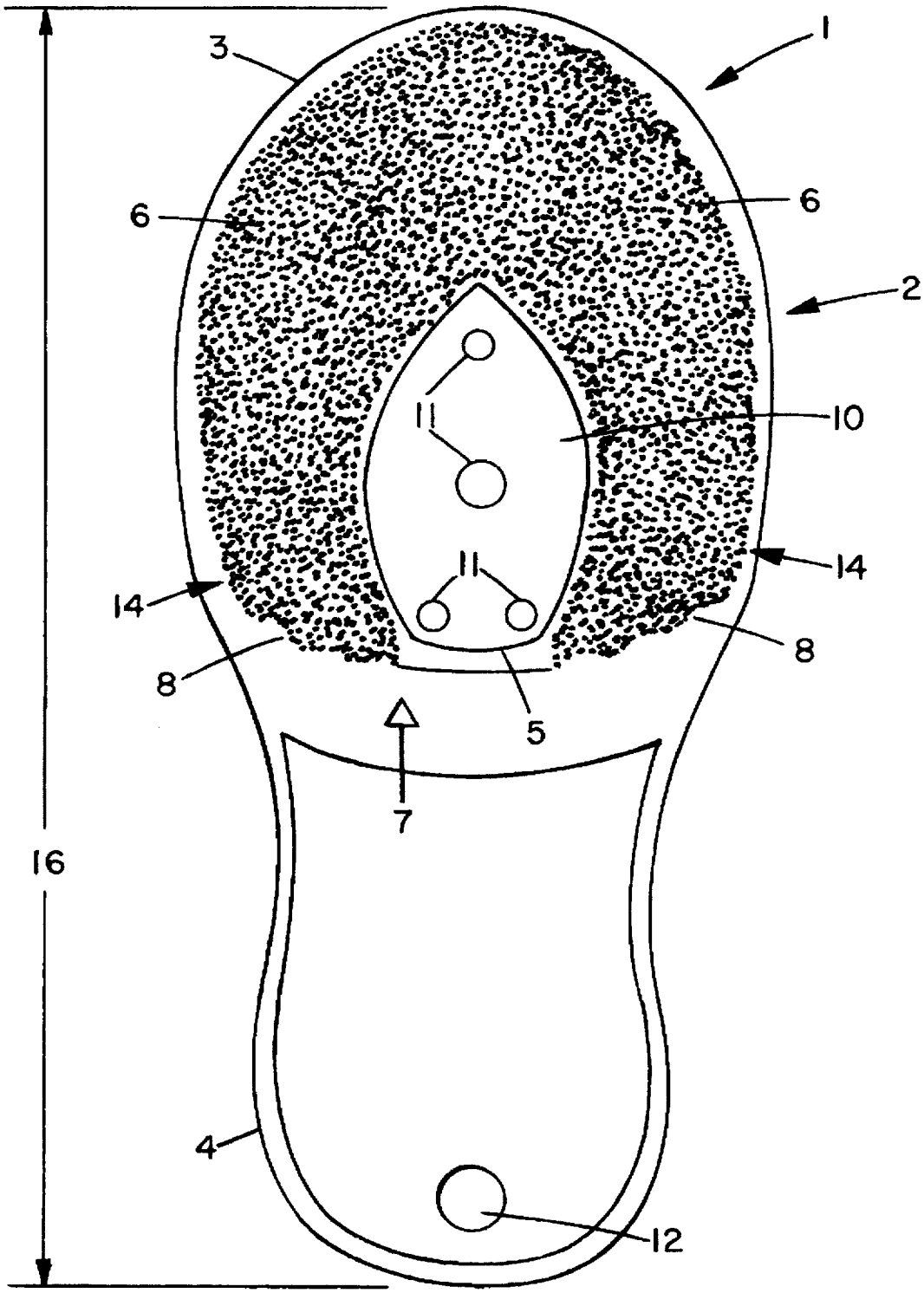
FIG. 1 is a plan view of one embodiment of the present invention.

Having regard to the drawings, them is illustrated a foot brush generally indicated by arrow 1. The foot brush 1 comprises a body, generally indicated by arrow 2, the body having a front portion 3 and a rear portion 4.

The front portion 3 of the body 2 is provided with a soap locating region generally indicated by arrow 5, and there is also provided a tuft of bristles 6 embedded within and projecting from the front portion 3, in the vicinity of the soap locating region 5.

The tuft of bristles 6 partially surrounds the soap locating region 5 in a substantially U-shaped formation. The open end of the U-shaped formation of the tuft of bristles 6 faces the rear portion 4 of the body 2. The mason for this configuration is that a user's foot, when being brushed forward, in the direction shown by arrow 7, will contact the bar of soap 9 (see FIG. 3) at the same time as striking the front region 8 of the tuft of bristles 6. Hence, the user's foot will be soaped at the same time as it is being cleaned or scrubbed.

The soap locating region 5 is in the form of a cavity 10 formed within the front portion 3 of the body 2, the cavity being adapted to receive and retain the bar of soap 9 therein.

The front and rear portions 3,4 comprising the body 2 are integrally formed from polypropylene by injection moulding techniques. The cavity 10 is integrally formed within the front portion 3.

The cavity 10 is provided with four drainage holes 11 to allow water to drain from the cavity 10. The reason for this is that the bar of soap 9 may become soggy or may otherwise deteriorate if water is retained within the cavity 10 when the foot brush 1 is not being used.

The rear portion 4 of the body 2 consists of a substantially thin and flat flange-type portion. The front portion 3 of the body 2 is elevated or raised relative to the rear portion 4. The main advantage for having the front portion 3 raised relative to the rear portion 4 is that the tuft of bristles 6 and/or the soap 9 of the foot brush 1 are more easily or readily accessed as compared to having the front portion 3 substantially flush with the rear portion 4. Furthermore, having the front portion 3 raised relative to the rear portion 4 ensures that the foot placed upon the rear portion 4 to prevent movement of the foot brush will not get in the way of or otherwise hinder the other foot as it is being cleaned or scrubbed.

The rear portion 4 is provided with an aperture 12 so that the foot brush 1 may be hung from a wall.

It may be seen from the drawings that the underside 13 of the body 2 of the foot brush 1 is substantially flat so that the foot brush 1 will lie flat on a floor surface.

Figure 2:
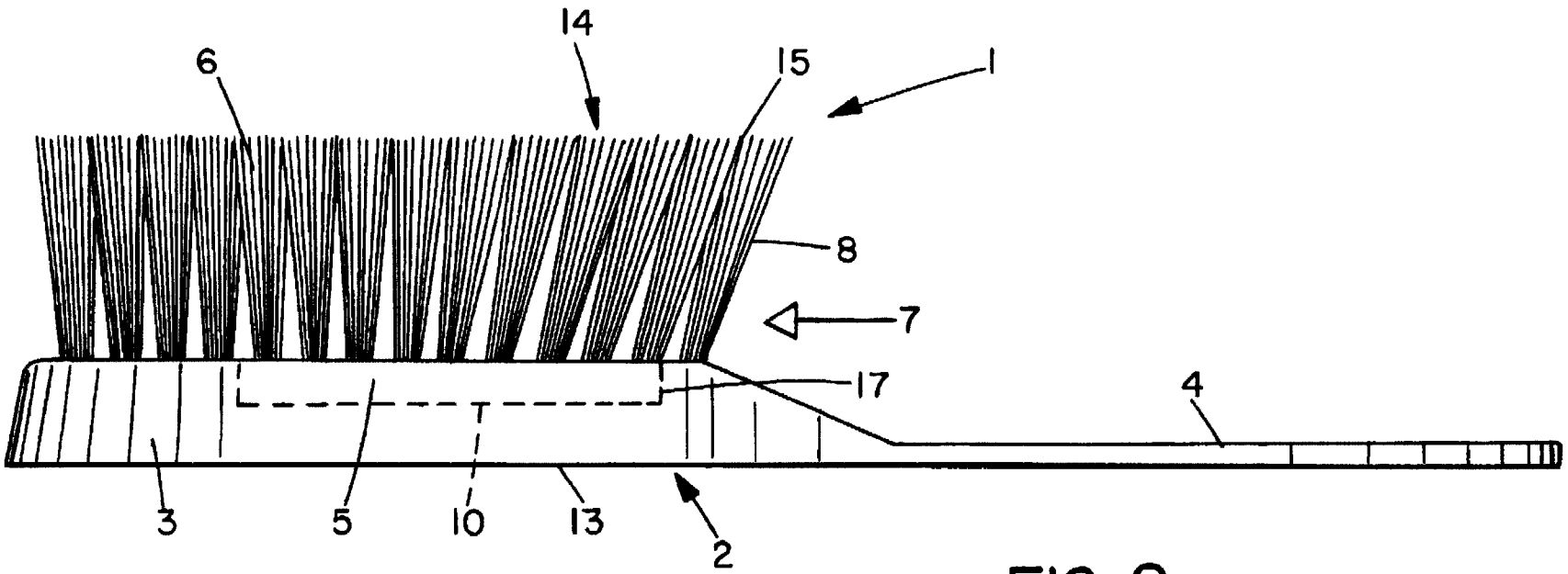
FIG. 2 is a side view of the embodiment shown in FIG. 1.

Having regard to FIG. 2, it may be seen that the front rows of bristles, generally indicated by arrow 14, are inclined towards the rear portion 4. An advantage of having the bristles 14 so inclined is that the ends or tips of the bristles, generally indicated by arrow 15, have a greater effectiveness in cleaning or scrubbing a user's feet than if they were disposed substantially vertically with respect to the body 2 of the foot brush 1. That is, the inclined tips or points 15 of the front bristles 14 tend to dig into and more efficiently clean or scrub a user's foot than if they were substantially upright or inclined away from the rear portion.

In another embodiment (not illustrated), the entire tuft of bristles 6 may be inclined in the same fashion as the front bristles 14 (as illustrated in FIG. 2). Such an embodiment would be equally, if not more, effective than the embodiment shown in FIG. 2.

The tuft of bristles 6 consists of crimped nylon bristles.

Figure 3:
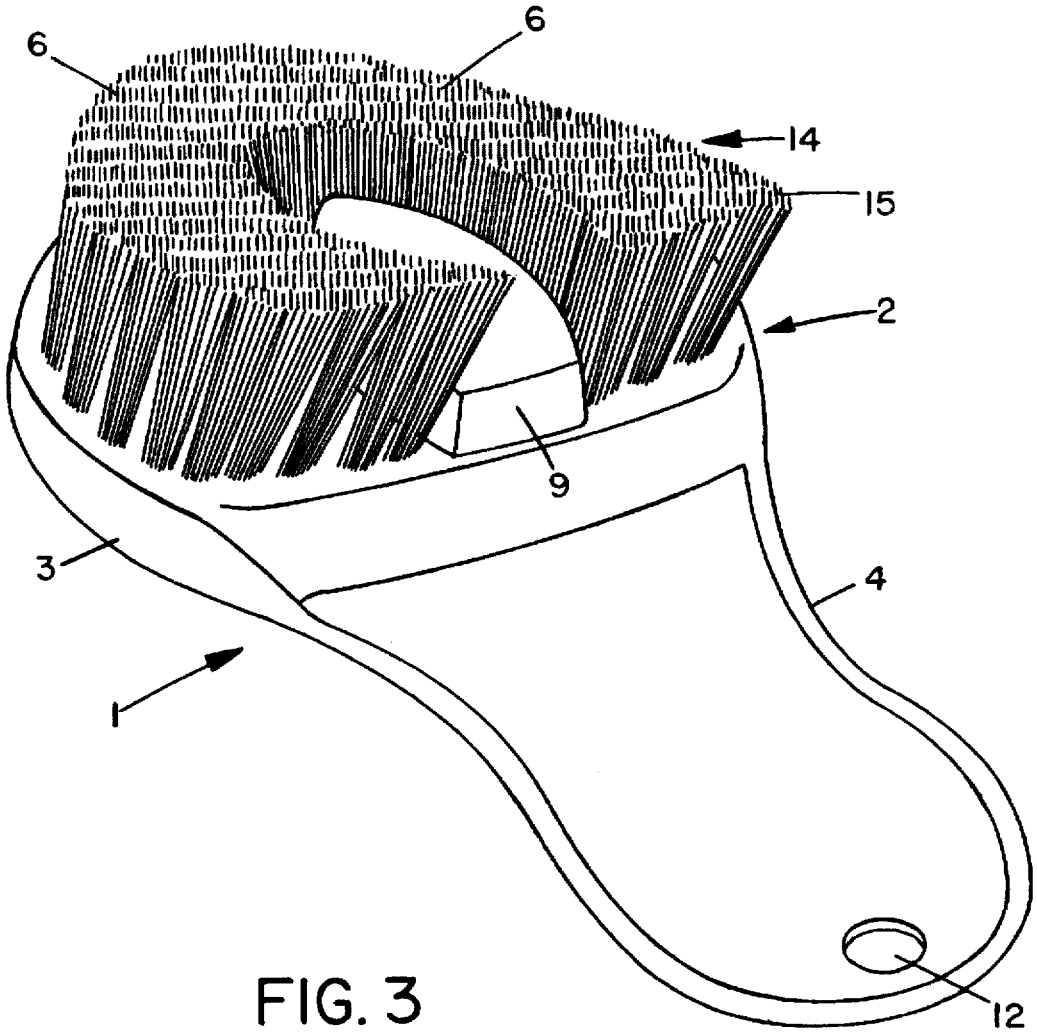
FIG. 3 is a perspective view of the embodiments shown in FIGS. 1 and 2 with a bar of soap incorporated within the soap locating region.

Having regard to FIG. 3, it may be seen that the bar of soap 9 is specifically shaped or is of an appropriate dimension to fit snugly within the cavity I 0 of the soap locating region 5. The bar of soap consists of a standard bar of bathroom soap, but is impregnated with anti-fungal products, to prevent or treat athlete's foot.

In the embodiment illustrated in the drawings, the length 16 of the brush 1 is 275 mm. The depth 17 of the cavity 10 is 5 mm. All other dimensions are to scale.

The foot brush 1 may be utilized as follows. Firstly, a user of the foot brush 1 may place one foot on the rear portion 4 of the body 2 to firmly hold the foot brush 1 in place and to prevent it from moving. It is found that the weight of a person is sufficient to prevent the foot brush 1 from moving. The user of the foot brush 1 may then clean or scrub the other foot by rubbing it backwards and/or forwards over or through the tuft of bristles 6 and the soap 9 of the foot brush 1.

After the foot has been adequately cleaned or scrubbed, the user may swap feet whereby the freshly cleaned or scrubbed foot is placed on the rear portion 4 of the body 2 to prevent movement of the foot brush 1 whilst the other foot is cleaned or scrubbed in the same fashion.

One advantage of the present invention, over and above presently available brushes for cleaning the feet, is that the foot brush 1 is essentially a self-soaping foot brush and a user of the foot brush 1 does not have to separately soap his/her feet or a brush to be used for cleaning the feet. Another advantage of the present invention is that use of the foot brush 1 does not require the use of any bending by a user of the foot brush 1. Moreover, we have found that having the tuft of bristles 6 inclined towards the rear portion 4 of the foot brush 1 results in the foot brush 1 being much more effective in cleaning or scrubbing a user's feet as compared to a brush which has the bristles extending substantially vertically from the brush. Another advantage or feature of the present invention is the fact that the rear portion 4 of the foot brush 1 is specifically designed or adapted to be retained by one foot whilst the other foot is being cleaned or scrubbed.

Aspects of the present invention have been described by way of example only and it should be appreciated that modifications and additions may be made thereto without departing from the scope thereof as defined in the appended claims.

I claim:

1. A foot brush, comprising:

a body having a front portion and a rear portion;

the front portion having a soap locating region;

a tuft of bristles embedded in and projecting from the front portion in the vicinity of the soap locating region; and the rear portion of the body comprising means for engagement by one foot of a user, whereby the foot brush is prevented from moving while the user scrubs the other foot over the tuft of bristles and soap in the soap locating region.

2. A foot brush as claimed in claim 1, wherein the tuft of bristles partially surrounds the soap locating region.

3. A foot brush as claimed in claim 2, wherein the tuft of bristles is in a substantially U-shaped formation around the soap locating region.

4. A foot brush as claimed in claim 3, wherein the open end of the U-shaped formation of the tuft of bristles faces the rear portion of the body.

5. A foot brush as claimed in claim 1, wherein the tuft of bristles fully surrounds the soap locating region.

6. A foot brush as claimed in any one of claims 1–5, wherein at least some of the tuft of bristles are inclined towards the rear portion of the body.

7. A foot brush as claimed in any one of claims 1–5, wherein the front portion is elevated relative to the rear portion.

8. A foot brush as claimed in any one of claims 1–5, wherein the front portion of the body has a cavity for receiving a bar of soap.

9. A foot brush as claimed in any one of claims 1–5, wherein the soap locating region is provided with one or more drainage holes.

10. A foot brush as claimed in any one of claims 1–5, wherein the rear portion of the body is provided with an aperture to enable the foot brush to be hung from a wall.

11. A foot brush as claimed in any one of claims 1–5, wherein the first and second portions are integrally formed.

12. A foot brush as claimed in any one of claims 1–5, wherein the underside of the body of the foot brush consists of a substantially flat surface.

13. A foot brush as claimed in any one of claims 1–5, wherein both the top side and the underside of the rear portion of the body consist of substantially flat surfaces.

14. A foot brush as claimed in any one of claims 1–5, wherein the first and second portions of the body are formed of polypropylene.

15. A foot brush as claimed in any one of claims 1–5, wherein the tuft of bristles consists of crimped nylon bristles.

16. A foot brush, comprising:

a body having a front portion and a rear portion;

the front portion having a soap locating region;

a tuft of bristles embedded in and projecting from the front portion in the vicinity of the soap locating region; and the rear portion comprising a flat, spatulate member for engagement by one foot of a user to anchor the foot brush while the user cleans the other foot.

17. A combination of a foot brush and a bar of soap, wherein the foot brush comprises:

a body having a front portion and a rear portion;

the front portion having a soap locating region;

a tuft of bristles embedded in and projecting from the front portion in the vicinity of the soap locating region;

the rear portion of the body comprising means for engagement by one foot of a user, whereby the foot brush is prevented from moving while the user scrubs the other foot over the tuft of bristles and soap in the soap locating region; and a bar of soap of shape and dimensions for fitting in the soap locating region.

18. A method of cleaning human feet, comprising the steps of:

placing a bar of soap in a soap locating region on a front portion of a foot brush;

placing a first foot on a flat rear portion of a foot brush so as to anchor the foot brush against movement; and scrubbing the second foot by rubbing it back and forth over the bar of soap and a tuft of bristles projecting from the front portion of the foot brush.

19. A method as claimed in claim 18, further comprising the step of placing the scrubbed second foot on the rear portion of the body and scrubbing the first foot by rubbing it back and forth over the tuft of bristles and the bar of soap of the foot brush.

* * * * *